United States Patent [19]

Okamoto et al.

[11] Patent Number: 4,802,418

[45] Date of Patent: Feb. 7, 1989

[54] WHEELSET STEERING APPARATUS AND METHOD FOR THE TRUCK OF RAILWAY VEHICLES

[75] Inventors: Isao Okamoto, Musashino; Katsuyuki Terada, Kudamatsu; Hiromi Go, Kudamatsu; Michio Sebata, Kudamatsu; Hiroshi Higaki, Kudamatsu; Hideo Takai, Hikari, all of Japan

[73] Assignee: Hitachi, Ltd., Tokyo, Japan

[21] Appl. No.: 8,340

[22] Filed: Jan. 29, 1987

[30] Foreign Application Priority Data

Jan. 29, 1986 [JP] Japan ..... 61-15670

[51] Int. Cl.[4] ..... B61F 5/30

[52] U.S. Cl. ..... 105/167; 105/168

[58] Field of Search ..... 105/136, 167, 168, 171, 105/190.2, 197.05, 201, 228

[56] References Cited

U.S. PATENT DOCUMENTS 3,687,085 8/1972 Newman et al. ..... 105/167
3,862,606 1/1975 Scales ..... 105/167
3,961,582 6/1976 Paton et al. ..... 105/167
4,455,946 6/1984 List ..... 105/168
4,640,198 2/1987 Haupl ..... 105/168

OTHER PUBLICATIONS

Vehical Systems Dynamics 5 (1975/6), A. H. Wickens, pp. 15–46.

*Primary Examiner*—Sherman D. Basinger
*Assistant Examiner*—Stephen P. Avila
*Attorney, Agent, or Firm*—Antonelli, Terry & Wands

[57] ABSTRACT

A wheelset steering apparatus and method for the truck of railway vehicles, wherein an axle box rotatably provided on the opposite ends of the wheelset is elastically supported in the longitudinal direction as well as in the lateral direction of the truck with respect to a truck frame. Vertical loadings on the truck frame are carried by the axle box. A spring constant in the longitudinal direction of the truck in a state of being elastically supported with respect to the truck frame of the axle box is varied when the vehicle runs. The self-steering property of the wheelset is enhanced, and stability in running on a straight track is secured.

4 Claims, 3 Drawing Sheets

WHEELSET STEERING APPARATUS AND METHOD FOR THE TRUCK OF RAILWAY VEHICLES

BACKGROUND OF THE INVENTION

1. Field of the Invention

The present invention relates to a wheelset steering apparatus and a wheelset steering method for the truck of railway vehicles.

2. Description of the Prior Art

According to, for example, A. H. Wickens, "Steering and Dynamic Stability of Railway Vehicles", Vehicle System Dynamics, 1975/76, P15–46, the self-steering property of a wheelset is defined as an effort of movement of running of a wheelset 2, 2', with reference to a truck illustrated in FIG. 11, which is elastically supported on a truck frame 1, toward to a radial direction on a curved track. This self-steering property of the wheelset on the curved track is known to be better if the bending stiffness, $k_b$, of the wheelset 2, 2' (hereinafter called as 'bending stiffness') as given by Equation (1) is smaller, and the shearing stiffness, $k_s$, between the wheelsets 2, 2' (hereinafter called as 'shearing stiffness') as given by Equation (2) is larger.

$$k_b = k_x \cdot b^2 \tag{1}$$

where $k_x$ is a longitudinal spring constant per wheel; and b is a half of the lateral distance of the wheelset 2, 2'.

$$k_s = \frac{k_b \cdot k_y}{k_b + k_y a^2} + k_{rs} \tag{2}$$

where $k_y$ is a lateral spring constant per wheel;

a is a half of the longitudinal distance between the wheelsets 2, 2'; and $k_{rs}$ is a shearing spring constant directly provided between the wheelsets 2, 2'.

Meanwhile, the running stability on a straight track (the property of being runnable stably with a hunting motion of the wheelset being not sent forth but turning to damped vibration) is known to be better if the bending stiffness $k_b$ is larger and the shearing stiffness $k_s$ is smaller. Such relation, however, calls for inconsistent characteristics of the truck. Hence, there is a difficulty that either one of the two should have more importance attached and either one of the two must be sacrificed unavoidably.

SUMMARY OF THE INVENTION

An object of the present invention is to provide a wheelset steering apparatus and method for the truck of railway vehicles which can exhibit the self-steering property in running on the curved track as well as the running stability in running on the straight track satisfactorily.

First, the present invention is characterized in that it comprises a wheelset, a truck frame, an axle box to be rotatably installed on the wheelset, and an axle box retaining means which includes a first elastic means for retaining elastically the axle box in the longitudinal direction as well as in the lateral direction of the truck with regard to the truck frame while carrying vertical loadings on the truck frame with regard to the axle box, and a second elastic means being made variable in a spring constant in the longitudinal direction of the truck.

Secondly, the present invention is characterized in that by comprising a wheelset, a truck frame, an axle box to be rotatably installed on the wheelset, an axle box retaining means for retaining the axle box in a manner to be capable of varying a spring constant in the longitudinal direction of the truck with regard to the truck frame while carrying vertical loadings on the truck frame with regard to the axle box, and a curved track detecting means for detecting a curved track of a railway, the state of the truck in running on the curved track is detected and, according to said state of the truck in running on the curved track, the spring constant for the axle box in the longitudinal direction of the truck with regard to the truck frame is reduced.

Other objects and characteristics of the present invention will be clarified from the description hereinafter provided.

DESCRIPTION OF THE PREFERRED EMBODIMENTS

Figure 1:
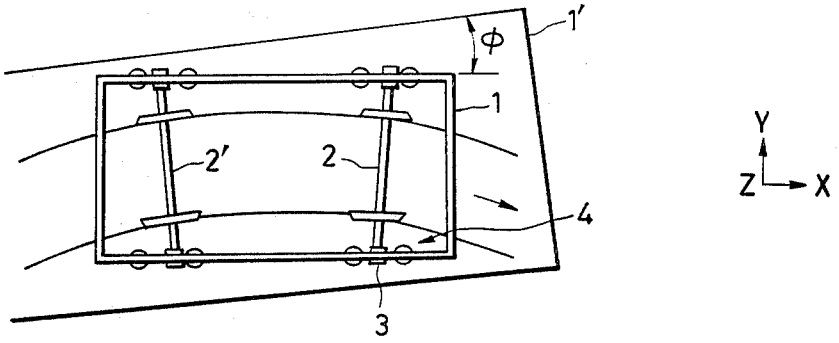
FIG. 1 is a plan view of the truck in running on the curved track, illustrating one embodiment of the present invention.
Figure 2:
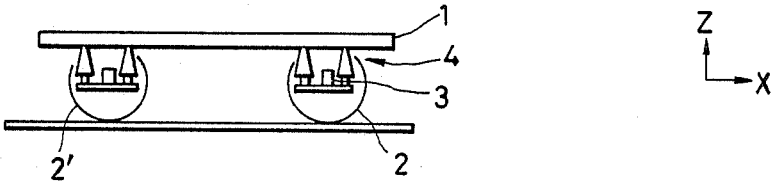
FIG. 2 is a side view of the truck in FIG. 1.

Hereinafter, the present invention will be described with reference to FIGS. 1 to 9.

FIGS. 1 to 5 illustrate the states of the truck of railway vehicles in running on the curved track. Reference numeral 3 is the axle box to be rotatably installed on the both ends of the wheelset 2, 2'. Reference numeral 4 is an axle box retainer, i.e., the axle box retaining means, to be provided between the above axle box 3 and the truck frame 1. The said axle box retainer 4 retains the axle box 3 in a specified position under the truck frame 1, while transmitting loadings on the truck frame 1 to the wheelset 2, 2' via the axle box 3 and elastically supporting the truck frame 1 at above the axle box 3. Then, the axle box retainer 4 will be described in detail. First, reference numeral 5 is a first spring corresponding to the first elastic means, which is made of rubber and the like having a ring shape, where a vertical spring constant is designated as $k_{zl}$ and a horizontal spring constant is as $k_{hl}$. Reference numeral 6 is an outer casing which is in touch, in the conical face thereof to be shaped inside, with the first spring 5 and is fixed to the truck frame 1. Reference numeral 7 is a cradle which is in touch, in the conical face thereof to be shaped outside, with the first spring 5 circumferentially and is fixed at the lower end thereof to the axle box 3. Reference numeral 8 is a second spring corresponding to the second elastic means, in which the spring constant is made different in two directions intersecting orthogonally within a horizontal plane, where the larger value of the spring constant is designated as $k_{hL2}$ and the smaller value of the spring constant is as $k_{hs2}$. Reference numeral 9 is a contact sleeve to be in contact with the internal face of the outer casing 6 circumferentially, and reference numeral 10 is an inner casing which is set to have the cradle 7 internally fitted in and to be rotatable with respect to the cradle 7. In such a construction, the second spring 8 is an elastic member made of an aeolotropic bush type rubber to be attached in a single direction between the contact sleeve 9 and the inner casing 10. Furthermore, in the part lower than the conical face of the outer casing 6 as shaped in the inside thereof, there is formed a cylindrical section in which the contact sleeve 9 is held and fitted rotatably with respect to a vertical axis. Then, in the part lower than the conical face of the cradle 7 as shaped in the outside thereof, there is formed a cylindrical section in which the inner casing 10 is held and fitted rotatably with respect to a vertical axis. The cylindrical sections between the outer casing 6 and the cradle 7 are elevated to correspond to each other when these two members are fitted in each other via the first spring 5. For this construction, the above mentioned axle box retainer 4 comprises the first spring 5, the outer casing 6, the cradle 7, the second spring 8, the contact sleeve 9 and the inner casing 10. Next, reference numeral 11 is a spring change-over unit corresponding to a spring change-over means. This spring change-over unit will then be described in detail. Reference numeral 12 is an angle detector for detecting the relative rotating angle within a horizontal plane between a vehicle body 1' and the truck frame 1. Reference numeral 12', which is connected to the angle detector 12, is a determination device for issuing a control signal when a result of detection by the angle detector 12 reaches a preset value $\alpha$ or higher values. Reference numeral 13 is an actuator which is caused to work by such a signal from the determination device 12', rotates only for a given number of revolution and then stops. Reference numeral 14 is a transmitter which transmits a rotating driving force of the actuator 13 into the inner casing 10 and causes the second spring 8 to turn. The transmitter 14 comprises a pinion 14' which turns by the actuator 13, and a gear 14'' which is installed in the outside circumference of the inner casing 10, is engaged into the pinion 14', and makes the inner casing 10 turn by turning of the pinion 14'. The spring change-over unit 11 includes the angle detector 12, the determination device 12', the actuator 13 and the transmitter 14. With reference to FIGS. 1 to 9, arrows shown with designation X, Y and Z indicate a longitudinal direction for X, a lateral direction for Y and a vertical direction for Z, with respect to the truck, respectively.

Figure 3:
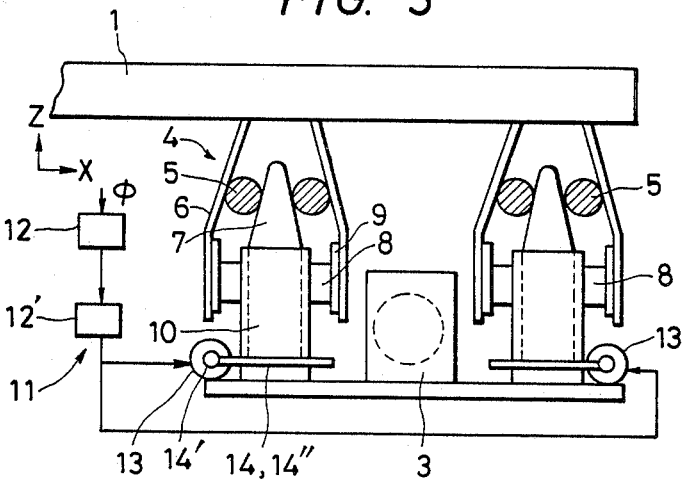
FIG. 3 is an enlarged sectional view of the axle box retaining means of the truck as shown in FIG. 2.
Figure 4:
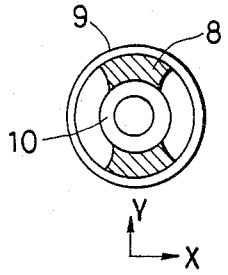
FIG. 4 is a plan view of a second spring in FIG. 3.
Figure 5:
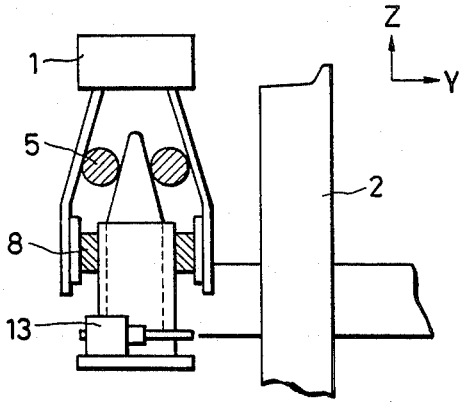
FIG. 5 is a sectional view of a first spring and a second spring of the axle box retaining means shown in FIG. 3, as seen in the lateral direction of the truck.

According to such a construction, when a vehicle runs into a curved track, there occurs a relative rotating angle, $\phi$, between the truck frame 1 and the vehicle body 1', within a horizontal plane. Such a rotating angle $\phi$ will become greater when a radius R of the above curved track is smaller. The said rotating angle $\phi$ is detected by the angle detector 12 and transmitted into the determination device 12'. Then, if the above rotating angle $\phi$ will be greater than the preset value $\alpha$ to be set in the determination device 12', the determination device 12' determines the state of the vehicle in running on the curved track and issues a control signal. By the control signal issued from the determination device 12', the actuator 13 drives the transmitter 14 to make the inner casing 10, the second spring 8 and the contact sleeve 9 rotate around a vertical axis and fix them at the respective positions as shown in FIGS. 3, 4 and 5. At this time, the spring constant in the axle box retainer 4 in a vertical direction, i.e., in the direction of Z, is the spring constant of the first spring 5, $k_{zl}$, which is unchanged always. On the other hand, the spring constant $k_x$ in the above mentioned state, namely, in the direction of X in running on the curved track, i.e., in the longitudinal direction of the truck and the spring constant $k_y$ in the direction of Y, i.e., in the lateral direction of the truck are as given by:

$$k_x = k_{hl} + k_{hs2}$$

$$k_y = k_{hl} + k_{hL2}$$

and, from Equation (1), it can be understood that the bending stiffness $k_b$ depending on the spring constant $k_x$ becomes small and the shearing stiffness $k_s$ which is essentially governed by the spring constant $k_y$ in Equation (2) becomes large.

Figure 6:
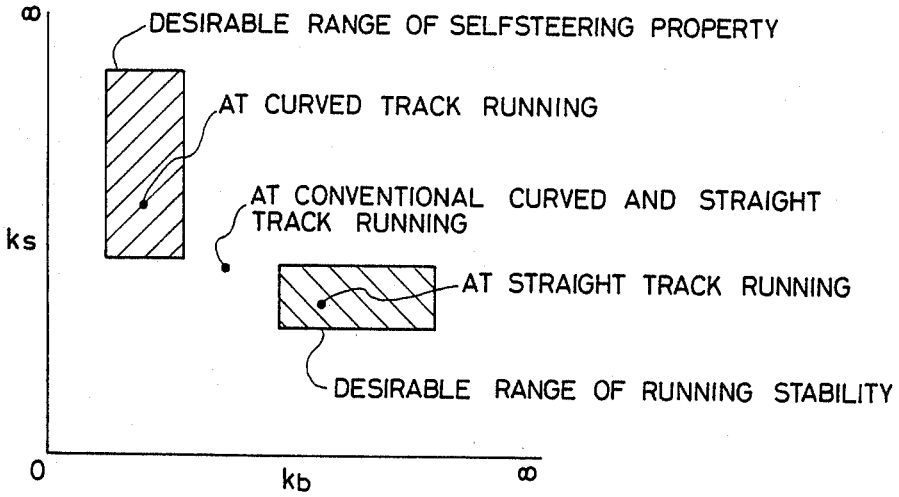
FIG. 6 is a diagram illustrating a variation in the bending stiffness $k_b$ versus the shearing stiffness $k_s$ on the curved track and the straight track.

FIG. 6 gives a range in which the self-steerability in the relation between the bending stiffness $k_b$ and the shearing stiffness $k_s$ will be desirable. According to the construction as above described, the bending stiffness $k_b$ in the above one embodiment is made smaller than the bending stiffness $k_b$ in the conventional truck, and the shearing stiffness $k_s$ in the above one embodiment is made larger than the shearing stiffness $k_s$ in the conventional truck, and, therefore, the self-steering property is substantially improved.

Figure 7:
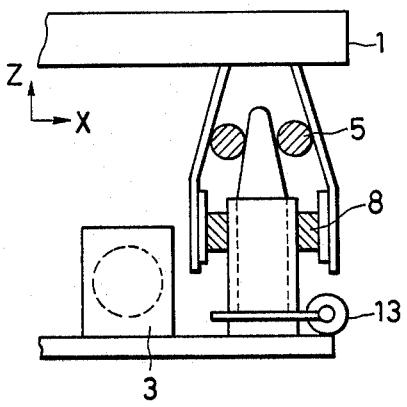
FIG. 7 is a sectional view for the same location as FIG. 3 in running on the straight track.
Figure 9:
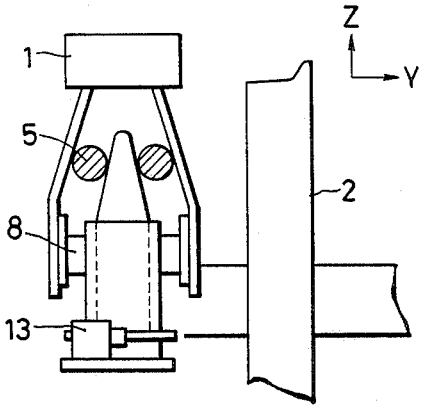
FIG. 9 is a sectional view of the first spring and the second spring in FIG. 7, as seen in the lateral direction of the truck.
Figure 8:
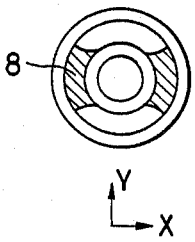
FIG. 8 is a plan view of the second spring in FIG. 7.

Meanwhile, when the vehicle runs into a straight track from the curved track, the relative rotating angle $\phi$ between the truck frame 1 and the vehicle body 1' within a horizontal plane to be detected by the angle detector 12 becomes smaller than the preset value $\alpha$ to be set in the determination device 12'. In this case, the determination device 12' issues no control signal, and, correspondingly, the actuator 13 drives the transmitter 14 in a reverse order of the aforementioned action to thereby cause the inner casing 10, the second spring 8 and the contact sleeve 9 to turn reversely around a vertical axis by 90 degrees. FIGS. 7, 8 and 9 illustrate such states, i.e., the states of the truck in running on the straight track. In these states, the spring constant $k_x$ in the direction of X, i.e., in the longitudinal direction of the truck, and the spring constant $k_y$ in the direction of Y, i.e., in the lateral direction of the truck, are as given by:

$$k_x = k_{hl} + k_{hL2}$$

$$k_y = k_{hl} + k_{hs2}$$

and, from Equation (1), the bending stiffness $k_b$ depending on the spring constant $k_x$ becomes large and the shearing stiffness $k_s$ which is essentially governed by the spring constant $k_y$ in Equation (2) becomes small. Thus, as shown in FIG. 6, in the case of running on the straight track, the values of the bending stiffness $k_b$ and the shearing stiffness $k_s$ for the truck can be fallen in the desirable range for the running stability, and, consequently, the running stability is substantially improved from the conventional level.

In this connection, if the spring change-over unit 11 is actuated only when a radius R of the curved track of a railway is small, the preset value $\alpha$ for the determination device 12' should be taken as a relatively high value.

In the one embodiment as above described, in addition to the above mentioned effects, the axle box retainer 4 can be made into a small size since the first spring 5 and the second spring 8 have the outer casing 6 and the cradle 7 in common.

Figure 10:
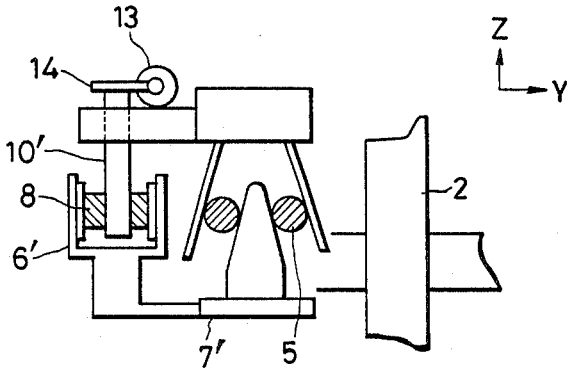
FIG. 10 is a side view of the same location as FIG. 5 above, illustrating another embodiment of the truck of railway vehicles according to the present invention.
Figure 11:
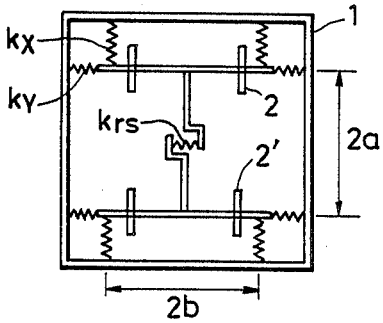
FIG. 11 is a plan view of a conventional truck.

FIG. 10 illustrates another embodiment of the truck of railway vehicles according to the present invention, in which like reference numerals represent like members in the one embodiment as above described. FIG. 10 gives the same location as FIG. 5 for the above first embodiment. The difference of this embodiment from the foregoing is in that a rotating shaft 10' corresponding to the inner casing 10 is installed rotatably in a location corresponding to the first spring 5 under the truck frame 1, and an outer casing 6' corresponding to the outer casing 6 is provided on a cradle 7' corresponding to the cradle 7 to meet with the rotating shaft 10'. Between the rotating shaft 10' and the outer casing 6' there is disposed the second spring 8. Likewise, the transmitter 14 is provided at the top end of the rotating shaft 10', and the actuator 13 is set in agreement with the transmitter 14. Accordingly, the transmitter 14 and the actuator 13 are supported by the truck frame 1. As means for controlling the actuator 13, the same as the angle detector 12 and the determination device 12' in the above described first embodiment are employed.

According to such a construction, not only th same effects as in the above described first embodiment can be accomplished, but also the vibration to be received by the actuator 13 can be reduced because of the construction such that the actuator 13 is supported on the truck frame 1, thereby making it possible to increase the reliability of the actuator 13.

In the above respective embodiments, the cradle is fixed to the axle box and the outer casing is fixed to the truck frame. However, the same effects as above described will be obtained even by making these arrangements in an alternating way, or by using a coil spring as the first spring.

Furthermore, in the above described respective embodiments, the angle detector and the determination device may be replaced by a transmitter provided at the ground side on the curved and straight tracks of a railway, which transmits a control output corresponding to the above described control signal, and by a receiver provided on the vehicle side for receiving the control output, in which case the actuator is still caused to work by a control signal from the receiver on the vehicle side. In such a modified construction, the same effects will be accomplished as well. Also, the second spring may be replaced by an air spring provided on the axle box in the longitudinal direction of the truck, since it may have a spring constant varying with a supply and discharge of the air.

As above described, according to the present invention, the value of bending stiffness can be made small and the value of shearing stiffness made large in running on the curved track, while the value of bending stiffness can be made large and the value of shearing stiffness made small in running on the straight track, thereby making it possible to provide a truck of railway vehicles which can exhibit the self-steering property in running on the curved track as well as the running stability in running on the straight track satisfactorily.

We claim:

1. A wheelset steering apparatus for a truck of a railway vehicle, comprising a wheelset, a truck frame, an axle box to be rotatably installed on said wheelset, and an axle box retaining means, which includes a first elastic means for retaining elastically said axle box in the longitudinal direction as well as in the lateral direction of the truck with regard to said truck frame while carrying vertical loadings on said truck frame with regard to said axle box, and a second elastic means having a variable spring constant in the longitudinal direction of the truck in the running condition of the vehicle such that a bending stiffness of said wheelset is smaller on a curved track than on a straight track and a shearing stiffness is larger on a curved track than on a straight track.

2. A wheelset steering method for a truck of railway vehicles, wherein by comprising a wheelset, a truck frame, an axle box to be rotatably installed on said wheelset, an axle box retaining means for retaining said axle box in a manner to be capable of varying a spring constant in the longitudinal direction of the truck with regard to said truck frame while carrying vertical loadings on said truck frame with regard to said axle box, and a curved track detecting means for detecting a curved track of a railway, the state of the truck in running on said curved track is detected and, according to said state of the truck in running on said curved track, the spring constant for said axle box in the longitudinal direction of the truck with regard to said truck frame is reduced.

3. A wheelset steering apparatus for a truck of railway vehicles, comprising a wheelset, a truck frame, an axle box to be installed on said wheelset, an outer casing whose internal face is formed to be conical and installed on said truck frame, a cradle to be combined with said axle box and whose external circumferential face is formed to be conical in such a manner as to oppose to said internal face of the outer casing and to allow a fit by insertion, a first elastic member having a ring shape, which is interposed between the internal face of said outer casing and the external circumferential face of the cradle and which elastically carries loadings in the longitudinal, lateral and vertical directions of the truck, and a second elastic member, which is provided between said outer casing and said cradle rotatably around a vertical axis and which has a spring constant made different in two directions intersecting orthogonally within a horizontal plane.

4. A wheelset steering apparatus for a truck of railway vehicles, comprising a wheelset, a truck frame, an axle box to be rotatably installed on said wheelset, an elastic member which can elastically retain said axle box in the longitudinal and lateral directions of the truck with respect to said truck frame, carry vertical loadings on the truck frame with respect to the axle box and reduce a spring constant in the longitudinal direction of the truck, and a spring change-over unit which detects a curved-track running condition of the vehicle to actuate said elastic member to reduce spring constant.

* * * * *